US006010331A

United States Patent [19]

Tingley

[11] Patent Number: 6,010,331

[45] Date of Patent: Jan. 4, 2000

[54] FIREPLACE CANDLE GRATE

[76] Inventor: Craig M. Tingley, 930 Halstead Dr., Marietta, Ga. 30064

[21] Appl. No.: 09/289,220

[22] Filed: Apr. 9, 1999

[51] Int. Cl.[7] ..... F23D 3/16

[52] U.S. Cl. ..... 431/295; 431/125; 126/540

[58] Field of Search ..... 431/295, 253; 126/540, 541

[56] References Cited

U.S. PATENT DOCUMENTS 4,529,160 7/1985 Chan et al. ..... 431/295

5,086,380 2/1992 Hedner ..... 431/295

*Primary Examiner*—Carroll Dority

*Attorney, Agent, or Firm*—Smith and Hopen, P.A.; Anton J. Hopen

[57] ABSTRACT

A fireplace candle grate comprising a plurality of longitudinally spaced, transversely disposed cradle members having a planer candle support surface on the end of one or more cradle members, a hollow sleeve surmounted on the candle support surface, the sleeve slideably receiving an end of said cradle members. Additionally, a lug may depending from the candle support surface, the lug having a mating aperture. A multifaceted mounting surface on an end of the sleeve is slideably received in the mating aperture wherein the incline of the candle support surface may be adjusted.

9 Claims, 3 Drawing Sheets

FIREPLACE CANDLE GRATE

FIELD OF INVENTION

The present invention relates generally to fireplace grates, and more particularly to a grate designed to hold candles.

BACKGROUND OF THE INVENTION

Fireplaces are utilized not only for warmth, but also for the pleasing light and ambience they produce. However, it is often too warm to effectively utilize the fireplace, particularly in temperate climates. Furthermore, expending wood for the resultant light and ambience is expensive and wasteful.

Attempts have been made to utilize incandescent lighting to simulate the flames of a fireplace. However, the resultant lighting often does not produce the flickering of a real flame. Additionally, it requires either battery or corded electrical power to operate. Batteries require periodic replacement and fireplaces are generally not built with electrical outlets installed, thus requiring the running of electrical wire in some fashion.

An alternative solution is to use inexpensive candles as a flickering light source by placing them inside the fireplace. Thus, no electrical power is required and the candle produces a real flickering light source. However, a number of problems exist by simply placing candles on the floor of a fireplace. First, the candles may become dirty from soot on the floor. Second, the candles produce light on the same horizontal plane as the bottom of the fireplace wherein the maximum amount of light should be directed outward from the center of the fireplace opening. A candle holder may be used to stager the candles at various locations. However, the candle holder must be removed from the fireplace when wood is to be burned, particularly on a grate.

Logs in a fireplace are usually held by a grate. Most grates have four legs, and a plurality of longitudinally spaced apart, transversely disposed cradle members for holding the logs. The grate permits the wood to be burned safely and the resultant ashes to fall through the grate for easy cleaning. However, placing candles on a standard fireplace grate is impractical as there are no planer surfaces to hold the candles level.

Consequently, there is a need in the art for an apparatus able to provide the lighting effect of a burning fireplace yet only consume the resources of one or more regular candles.

There is a further need in the art for an apparatus that provides the dual-function of a candle holder and a fireplace grate.

However, in view of the prior art in at the time the present invention was made, it was not obvious to those of ordinary skill in the pertinent art how the identified needs could be fulfilled.

SUMMARY OF THE INVENTION

The present invention solves significant problems in the art by providing a novel apparatus giving the lighting effect of a burning fireplace yet only consuming the resources of one or more regular candles. The apparatus also provides the dual-function of a candle holder and a fireplace grate.

The above and other objects of the invention are achieved in the embodiments described herein by providing a fireplace candle grate comprising a plurality of longitudinally spaced, transversely disposed cradle members having a planer candle support surface on the end of one or more cradle members. The planer candle support surface holds a typical burning candle and is substantially horizontal in inclination. In a preferred embodiment, the candle support surfaces and cradle members are fabricated as a unity structure of cast iron which is durable and heat resistant. However, any other thermal resistant material may be employed.

As an alternative embodiment, the candle support surface is mounted on a hollow sleeve which is slideably received by an end of a cradle member. In this arrangement, the candle support surfaces may be easily installed or removed from the grate depending on individual preferences.

Candle support surfaces may be manufactured for existing fireplace grates. However, the ends of many grates may have differing inclinations. To overcome this problem, an alternative construction may be employed. A lug depending from the candle support surface has a multifaceted mating aperture. A multifaceted mounting surface on an end of the sleeve is slideably received in the mating aperture wherein the incline of said candle support surface may be adjusted for various grates. Alternative rotatable fastening means may be utilized such as a nut-and-bolt or ratchet arrangement.

The sleeve may be rigidly secured onto the end of a cradle member by a number of means. In a preferred embodiment, one or more bores in the sleeve threadably receive a set screw wherein the tightening of the set screw bears against the cradle member end and thereby rigidly securing the sleeve to said cradle member. The adjustable set screw permits use of the sleeve with a variety of preexisting fireplace grates.

An object of this invention is to provide an apparatus able to provide the lighting effect of a burning fireplace yet only consume the resources of one or more regular candles.

Another object of this invention is to provide an apparatus that provides the dual-function of a candle holder and a fireplace grate.

An advantage of the invention is that a single apparatus may provide the dual function of a candle holder and fireplace grate using substantially the same amount of materials. Therefore, it is less expensive to purchase the combined fireplace candle grate than separately purchasing a regular fireplace grate and a separate candle holder.

Another advantage of the invention is that all combustion, whether from wood or from candles takes place in the fireplace having proper ventilation. Thus, byproducts from candle burning which may cause allergies, dust and the like are localized in the fireplace wherein they are less likely to come into contact with other parts of the structure.

Another advantage of the invention is that burning candles within the fireplace is less likely to produce an uncontrolled fire. Candles are often burned on a table near flammable material or in close proximity to people or pets. This increases the likelihood of injury or structural damage. Fireplaces are designed to safely handle fires and the same design may be utilized for safely burning candles.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
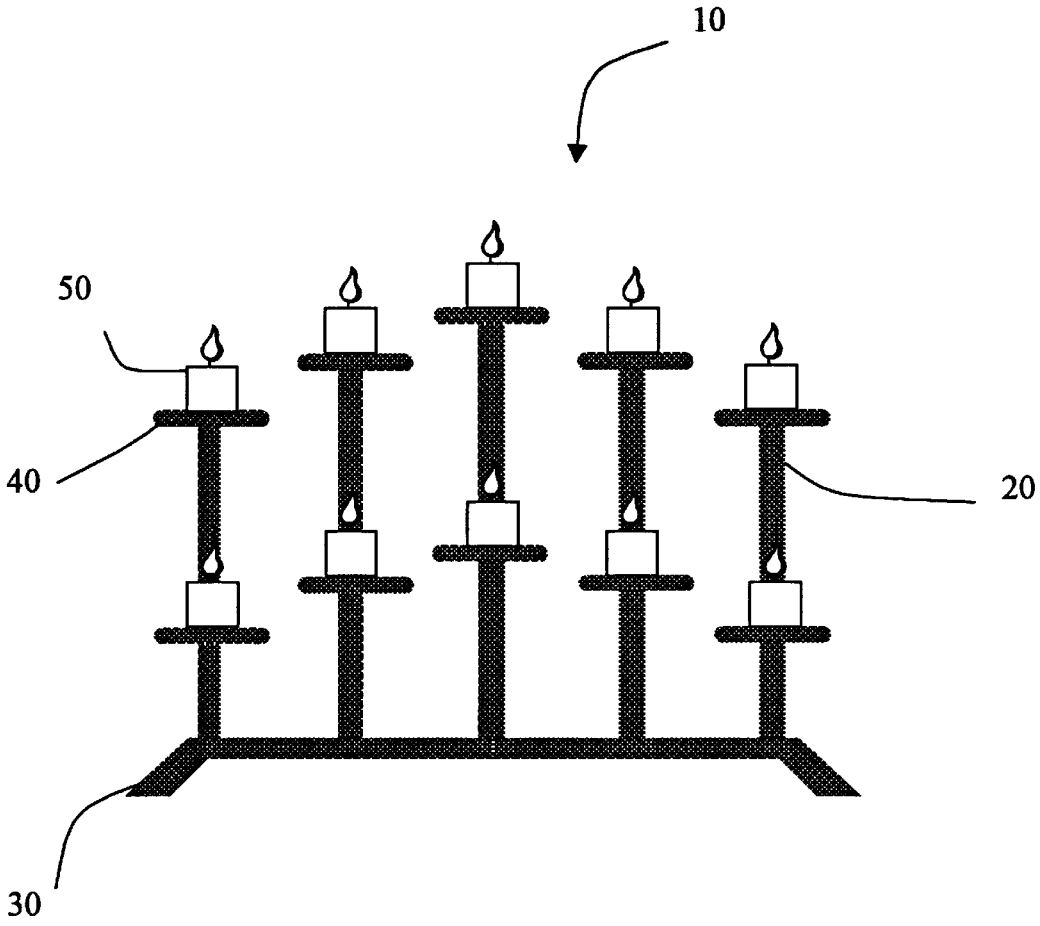
FIG. 1 is a front elevational view of a preferred embodiment of the fireplace candle grate according to the invention.

Referring initially to FIG. 1, it will there be seen that an illustrative embodiment of the present invention is denoted by the reference number 10 as a whole.

A plurality of longitudinally spaced, transversely disposed cradle members 20 are rigidly interconnected by at least one support leg 30. At the end of each cradle member 20 is rigidly secured a planer candle support surface 40 supporting a standard candle 50. In the example in FIG. 1, ten candle support surfaces 40 hold ten candles 50. However, only one or more candles may be utilized at any time. Furthermore, regular wood sticks or logs may be supported by the cradle members for combustion.

In a preferred embodiment of the invention, the candle support surfaces are integral to the cradle members by welding, casting or similar means to create a single metal structure. It is also preferred that the assembly be created of cast iron which is resistant to high heat and wear. It is also preferred that the heights of the candle support surfaces 40 are staggered wherein one candle does not block the light of another candle.

Figure 2:
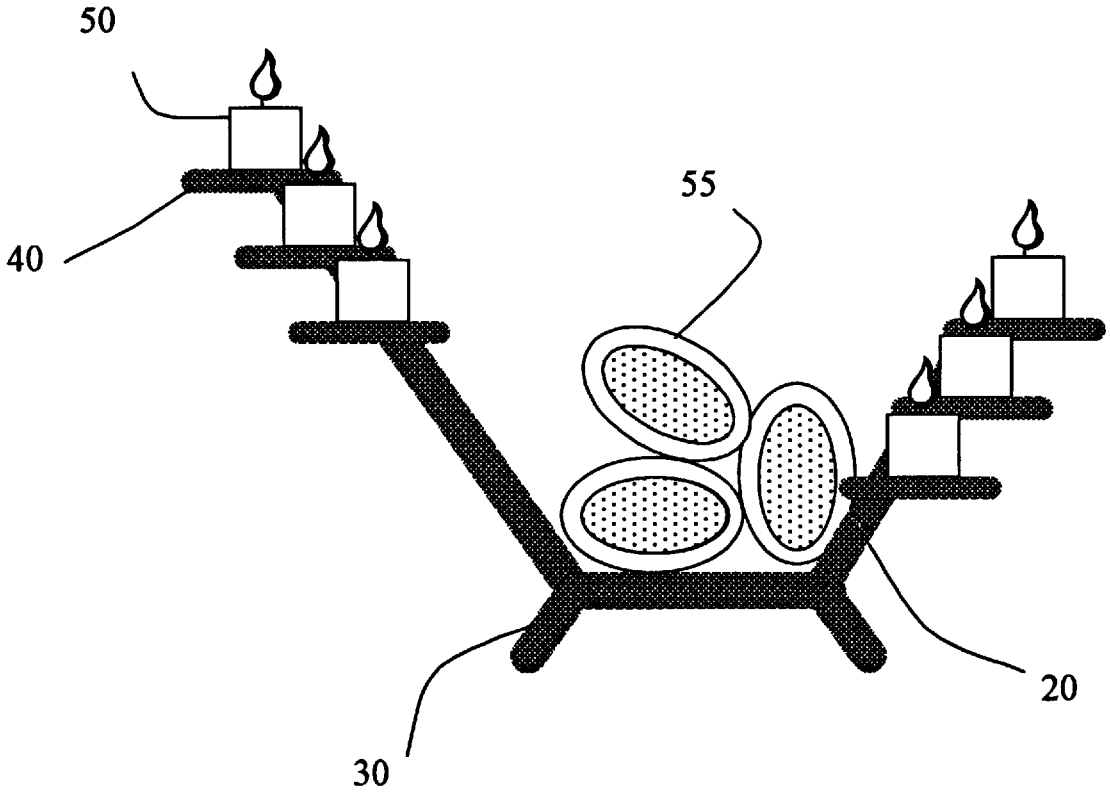
FIG. 2 is a side elevational view of a preferred embodiment of the fireplace candle grate according to the invention.

FIG. 2 shows a side view of the invention holding combustible logs 55. In a preferred embodiment of the invention, the cradle members comprise non-curved, angular bends which provides a greater capacity to place logs 55 between the candle support surfaces 40. Alternatively, the cradle members may be of curved design.

Figure 3:
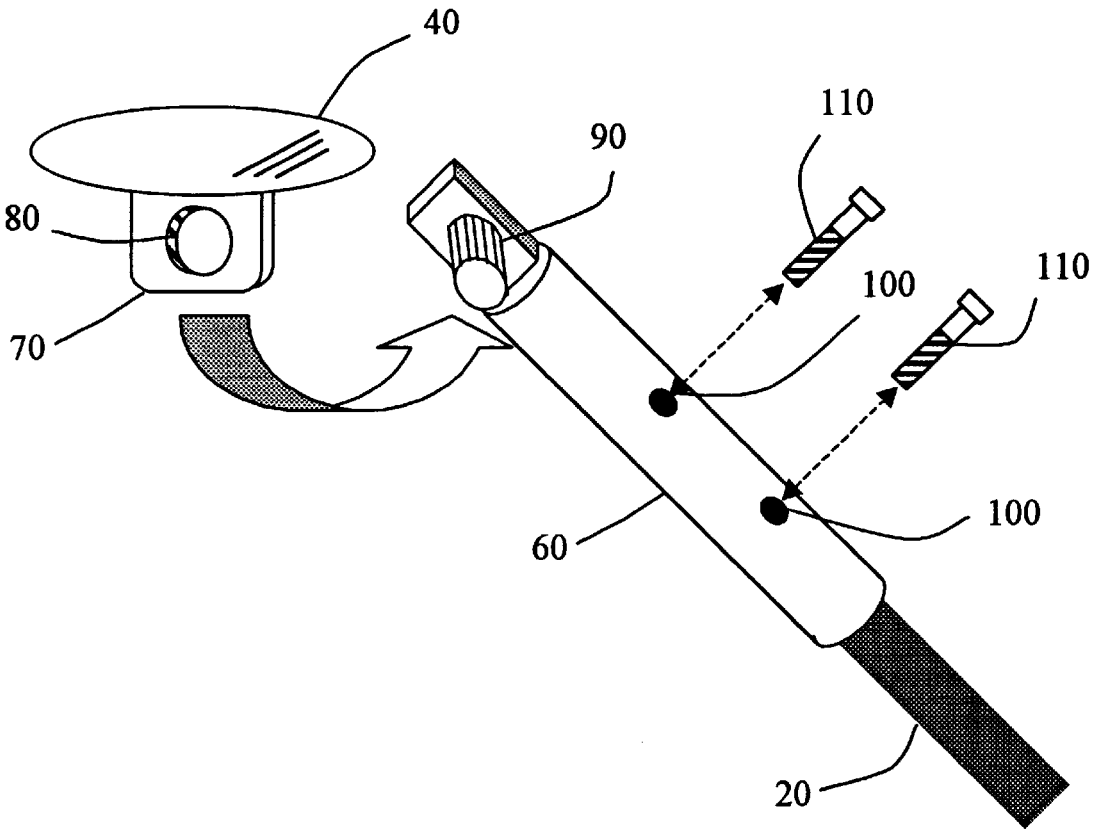
FIG. 3 is an exploded perspective view of the adjustable candle support surface and sleeve according to the invention.

FIG. 3 illustrates an alternative to the integral candle support surface. A hollow sleeve 60 slideably receives an end of a cradle member 20. The sleeve 60 may be secured to the cradle member 20 by one or more set screws 110 threadably received by one or more threaded bores 100 in the sleeve 60. The set screws 110 permit the sleeve 60 to be rigidly secured to preexisting cradle members 20 having varying diameters.

A lug 70 depends from the candle support surface 40 in a substantially perpendicular orientation. A multifaceted mating aperture 80 is formed within the lug 70. The aperture 80 slideably receives a multifaceted mounting surface 90 on the end of the sleeve 60 which permits the incline of the candle support surface 40 to be adjusted. Therefore, if the cradle member 20 is oriented at a thirty degree angle upwards, the candle support surface 40 may be rotated an additional sixty degrees to a horizontal position. An advantage of the multifaceted aperture and mounting is that is requires no separate hardware to be lost such as bolts, pins or the like. However, alternative rotatable fastening means may be utilized such as a nut-and-bolt or ratchet arrangement.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A fireplace candle grate comprising:

a plurality of longitudinally spaced, transversely disposed cradle members having a planer candle support surface on the end of one or more cradle members.

2. The fireplace candle grate described in claim 1 further comprising a hollow sleeve surmounted on said candle support surface, said sleeve slideably receiving an end of said cradle members.

3. The fireplace candle grate described in claim 2 further comprising a lug depending from said candle support surface, said lug having a fastening means rotatably coupled to an end of said sleeve wherein the incline of said candle support surface may be adjusted.

4. The fireplace candle grate described in claim 3 wherein said fastening means comprises a lug depending from said candle support surface, said lug having a multifaceted mating aperture, a multifaceted mounting surface on an end of said sleeve, said mounting surface slideably received in said mating aperture wherein the incline of said candle support surface may be adjusted.

5. The fireplace candle grate described in claim 1 further comprising one or more threaded bores in said sleeve threadably receiving a set screw wherein the tightening of said set screw bears against said cradle member end and thereby rigidly securing said sleeve to said cradle member.

6. A candle holder sleeve slideably receiving an end of a fireplace grate member, said sleeve having a planer candle support surface.

7. The candle holder sleeve of claim 6 further comprising a lug depending from said candle support surface, said lug having a fastening means rotatably coupled to an end of said sleeve wherein the incline of said candle support surface may be adjusted.

8. The candle holder sleeve of claim 7 wherein said fastening means comprises a lug depending from said candle support surface, said lug having a multifaceted mating aperture, a multifaceted mounting surface on an end of said sleeve, said mounting surface slideably received in said mating aperture wherein the incline of said candle support surface may be adjusted.

9. The candle holder sleeve of claim 6 further comprising one or more bores in said sleeve threadably receiving a set screw wherein the tightening of said set screw bears against said cradle member end and thereby rigidly securing said sleeve to said cradle member.

* * * * *